US009745154B1

(12) United States Patent
Lawrence et al.

(10) Patent No.: US 9,745,154 B1
(45) Date of Patent: Aug. 29, 2017

(54) REMOVABLE MEDIA TRAY HAVING A HIGH LATCHING FORCE AND A LOW OPENING FORCE

(71) Applicant: LEXMARK INTERNATIONAL, INC., Lexington, KY (US)

(72) Inventors: Michael William Lawrence, Lexington, KY (US); Dustin Daniel Fichter, Versailles, KY (US); Neal Douglas McFarland, Versailles, KY (US); Stacey Vaughan Mitchell, Lexington, KY (US); Angel Macuha Alagos, Cebu (PH); Douglas Andagan Baena, Jr., Dumaguete (PH); Pat Marlon Cartagena Limosnero, Cebu (PH)

(73) Assignee: Lexmark International Inc., Lexington, KY (US)

( * ) Notice: Subject to any disclaimer, the term of this patent is extended or adjusted under 35 U.S.C. 154(b) by 0 days.

(21) Appl. No.: 15/052,997

(22) Filed: Feb. 25, 2016

(51) Int. Cl.

| | |
|---|---|
| ***B65H 1/26*** | (2006.01) |
| ***B41J 11/58*** | (2006.01) |
| ***B65H 1/04*** | (2006.01) |

(52) U.S. Cl.
CPC ..... *B65H 1/266* (2013.01); *B41J 11/58* (2013.01); *B65H 1/04* (2013.01); *B65H 2405/121* (2013.01); *B65H 2405/32* (2013.01); *B65H 2555/42* (2013.01)

(58) Field of Classification Search
CPC .... B65H 1/266; B65H 1/04; B65H 2405/121; B65H 2405/32
See application file for complete search history.

(56) References Cited

U.S. PATENT DOCUMENTS

| | | | | |
|---|---|---|---|---|
| 7,412,200 B2 * | 8/2008 | Gotoh | ..... | B65H 1/26 271/145 |
| 8,925,914 B2 * | 1/2015 | Naoi | ..... | B65H 1/04 271/145 |

FOREIGN PATENT DOCUMENTS

| | | | |
|---|---|---|---|
| JP | 2006008291 A | * | 1/2006 |
| JP | 2006298553 A | * | 11/2006 |

* cited by examiner

*Primary Examiner* — Luis A Gonzalez
(74) *Attorney, Agent, or Firm* — John Victor Pezdek

(57) ABSTRACT

A removable media tray assembly for an image forming device according to one embodiment includes a media tray having a bottom surface and a front wall extending upward from the bottom surface. A bottom surface defines a media storage location for storing a stack of media sheets. The assembly includes a housing having an opening therein to receive the media tray. A magnet and a plate provide a latching force FL greater than a pick motor stall force keeping the media tray in a closed position during media picking. A handle assembly including a finger bar and a pivoting link is mounted to the front wall. With the media tray being held closed by the latching force, a user-supplied actuation force FA that is less than 22.2 N applied to the finger bar, pivots the link which acts as a force multiplier providing a release force exceeding the latching force.

19 Claims, 12 Drawing Sheets

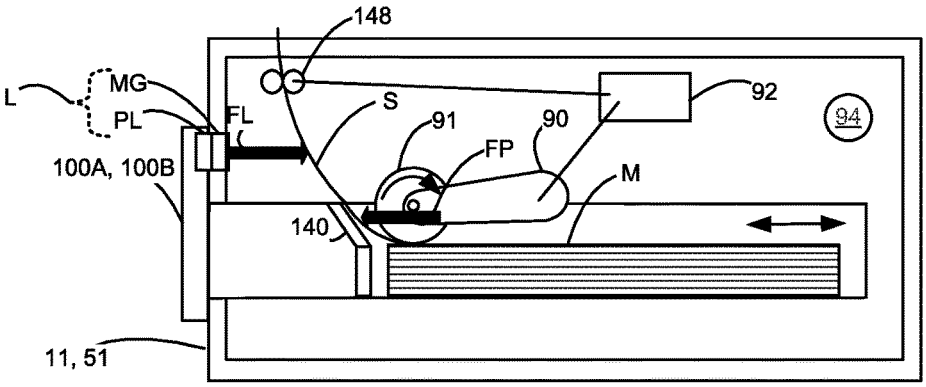
FIGURE 14
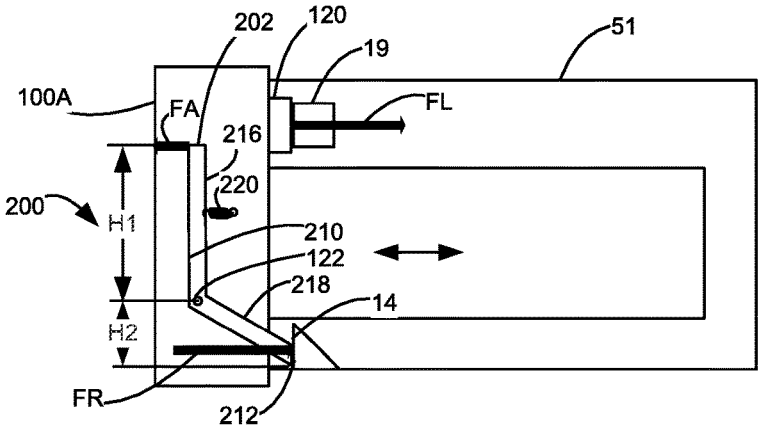
FIGURE 15
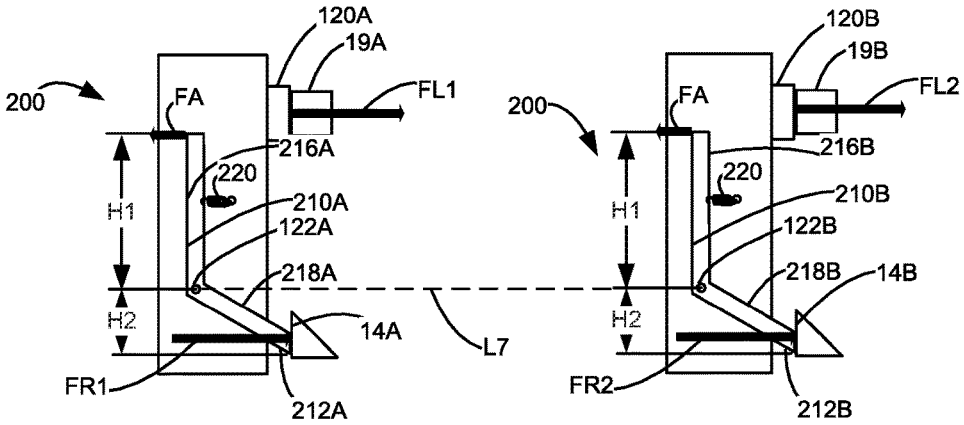
FIGURE 16A
FIGURE 16B

REMOVABLE MEDIA TRAY HAVING A HIGH LATCHING FORCE AND A LOW OPENING FORCE

CROSS REFERENCES TO RELATED APPLICATIONS

Statement Regarding Federally Sponsored Research or Development

None.

REFERENCE TO SEQUENTIAL LISTING, ETC

None.

BACKGROUND

Field of the Invention

The field relates generally to media input feed systems for an imaging device having a removable media tray.

Description of the Related Art

In 1998, Congress amended the Rehabilitation Act of 1973 (29 U.S.C. §794 (d)) to require Federal agencies to make their electronic and information technology accessible to people with disabilities. Section 508 of the Rehabilitation Act applies to all federal agencies when they develop, procure, maintain, or use electronic and information technology. Under Section 508, federal agencies must give disabled employees and members of the public access to information that is comparable to access available to others. These provisions apply to operable controls which are defined as components of a product that require physical contact for normal operation. Operable controls include, but are not limited to, input and output media trays. Operable controls are to be operable with one hand and not require tight grasping, pinching, or twisting of the wrist. The force required to activate operable controls shall not be greater than a maximum of five pounds (22.2 N). Thus, under these requirements, the force needed to close or open a media tray must not exceed 22.2 N.

Media trays having a media pick force applied along the same line on which the media tray is closed or opened are known as in-line media trays. However, inline media trays typically require a latching force in excess of 10 pounds (44.4 N) to keep the media tray closed during picking of media from the media tray and to prevent the media tray from opening or ejecting during a media pick operation or during a pick drive motor stall condition. The picking force applied by pick mechanism to ensure successful media picking is in most cases in excess of 22.2 N. In the past, these types of in-line media trays used spring-loaded latching devices to hold the media tray in place. However, the opening force required to overcome the latching force of these latching devices is in excess of the 22.2 N force limit required under Section 508.

It would be advantageous to have a media tray that may be opened and closed using a force less than of 22.2 N. It would be further advantageous, that such a media tray would also provide a high latching force (a force in excess of 22.2 N) that is greater than a media pick force or the maximum pick motor stall force and will remain closed during media picking operations or during a pick drive motor stall condition.

SUMMARY OF THE INVENTION

Disclosed is a removable media tray assembly for providing media to an imaging device. The removable media tray assembly comprises a housing having an opening therein to receive a removable media tray. The housing has a release surface and a magnet mounted adjacent the opening. The removable media tray has a bottom surface for holding media to be fed to the imaging device, a front wall extending upward from the bottom surface and a handle pivotable between a first position and a second position. The front wall has an inner surface having a ferromagnetic plate aligned with the magnet and an outer surface having a mount. The handle includes a finger bar transversely extending across a portion of the outer surface of the front wall and a link depending from the finger bar. A free end of the link is adjacent to the release surface. The link is pivotally mounted to the mount. The link has a first arm portion extending between the mount and the finger bar and a second arm portion extending from the mount to the free end of the link. The first arm portion has a vertical height H1 and the second arm portion has a vertical height H2. A biasing member is attached to the handle for biasing the handle in the first position.

With the removable media tray received into the housing, the magnet and plate in abutment provide a latching force FL holding the removable media tray in a closed position during media feeding. The latching force FL is greater than a pick force applied the media during feeding to the imaging device. A user-supplied actuation force FA applied to the finger bar pivots the handle toward the second position. The link, acting as a force multiplier, pivots about the mount applying a release force FR that is greater than the latching force FL to the release surface, opening the removable media tray and moving the removable media tray away from the magnet. The actuation force FA is in the range of 18 N to less than 22.2 N and the release force FR=FA(H1/H2).

In another form, the handle includes a first member and a second member pivotally mounted to upper and lower mounts, respectively, provided on the front wall of the removable media tray. The first and second members are each pivotable between a first position and a second position, respectively. The first member has a first end, a second end and a pivot member depending from the first end thereof. The first member has a first arm portion extending between the pivot member and the upper mount and has a vertical height H1. The first member has a second arm portion extending between the upper mount and the second end of the first member and has a vertical height H2. The second end of the first member is positioned adjacent to the release surface. The second member includes a finger bar transversely extending across a portion of the outer surface of the front wall, and, a link depending from the finger bar. A first end of the link is pivotally mounted to the lower mount and a second end of the link is connected to the finger bar. The link is moveable into contact with the pivot member of the first member. The link has a first arm portion extending between the lower mount and the pivot member of the first member and a second arm portion extending from the pivot member to the second end of the link. The first arm portion of the link has a vertical height H3 and the second arm portion has a vertical height H4. A biasing member is attached to the second member for biasing the second member in its first position which biases the first member into a respective first position.

With the removable media tray received into the housing, the magnet and plate in abutment provide a latching force FL holding the removable media tray in a closed position during media feeding. A user-supplied actuation force FA applied to the finger bar to move the second member from its first position to its second position pivots the second member about the lower mount contacting the pivot member of the first member pivoting the first member about the upper mount from its first position to its second position with the second end of the first member applying a release force FR to the release surface opening the removable media tray and moving the removable media tray away from the magnet. Again, the actuation force FA is less than 22.2 N while the release force FR=FA ((H3+H4)/H3)(H1/H2).

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings.

FIG. 14 is a schematic illustration of a removable media tray and housing depicting a latching force FL countering a media picking force FP to keep the removable media tray in a closed position.

FIG. 15 is a schematic illustration of another embodiment of the example handle of FIG. 10 utilizing a single link.

FIGS. 16A-16B are schematic illustrations of the release forces provided by the example handle of FIG. 10 having dual links to open a removable media tray.

DETAILED DESCRIPTION

Figure 1:
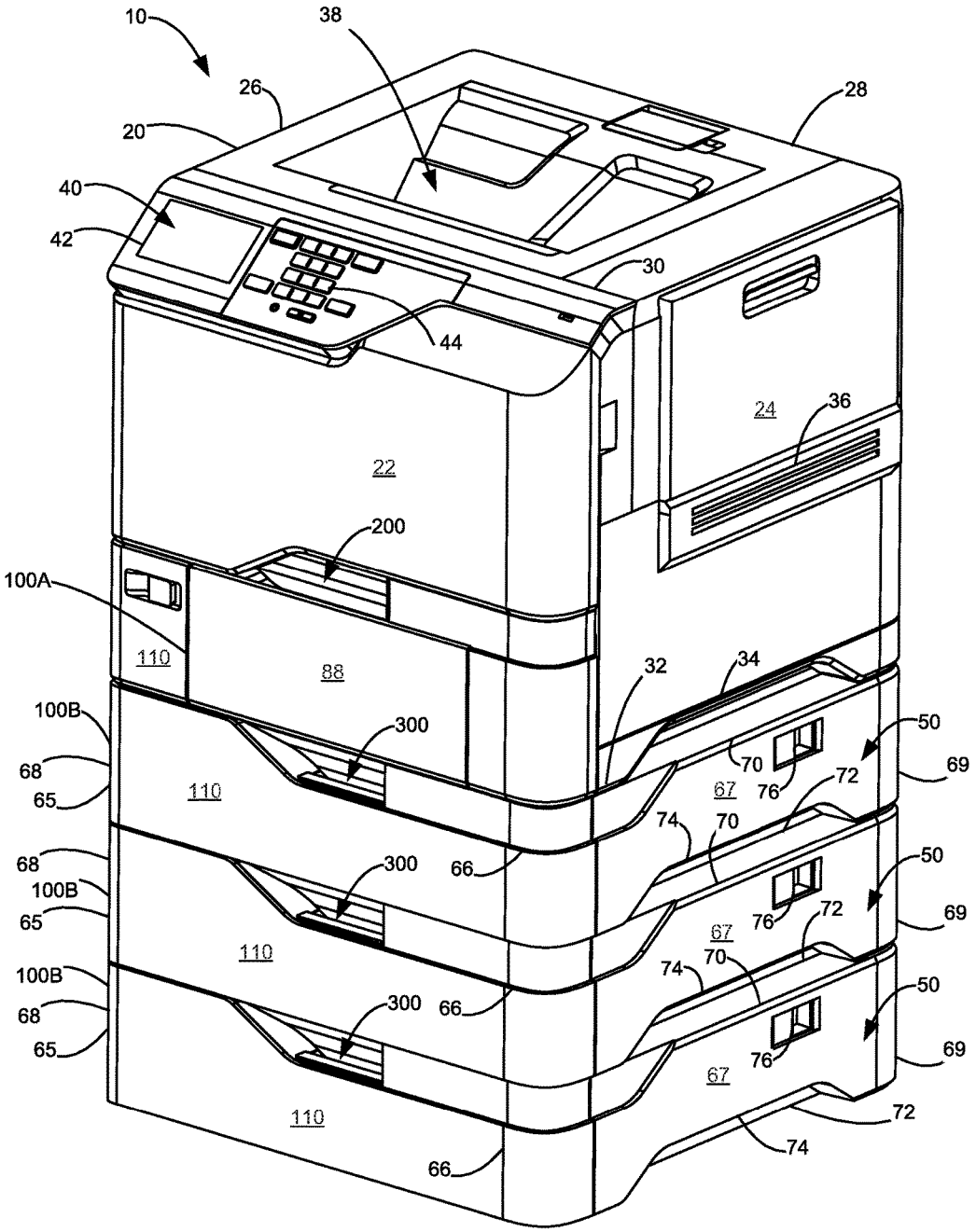
FIG. 1 is an illustration of the imaging device having a removable media tray attached to a stack of option assemblies each also having a removable media tray.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise. The use of "including", "comprising", or "having" and variations thereof herein is meant to encompass the items listed thereafter and equivalents thereof as well as additional items.

Terms such as "about" and the like have a contextual meaning, are used to describe various characteristics of an object, and have their ordinary and customary meaning to persons of ordinary skill in the pertinent art. Terms such as "about" and the like, in a first context mean "approximately" to an extent as understood by persons of ordinary skill in the pertinent art; and, in a second context, are used to describe various characteristics of an object, and in such second context mean "within a small percentage of" as understood by persons of ordinary skill in the pertinent art.

Unless limited otherwise, the terms "connected", "coupled", and "mounted", and variations thereof herein are used broadly and encompass direct and indirect connections, couplings, and mountings. In addition, the terms "connected" and "coupled" and variations thereof are not restricted to physical or mechanical connections or couplings. Spatially relative terms such as "left", "right", "top", "bottom", "front", "back", "rear", "side", "under", "below", "lower", "over", "upper", and the like, are used for ease of description to explain the positioning of one element relative to a second element. These terms are intended to encompass different orientations of the device in addition to different orientations than those depicted in the figures. Relative positional terms may be used herein. For example, "superior" means that an element is above another element. Conversely "inferior" means that an element is below or beneath another element. Further, terms such as "first", "second", and the like, are also used to describe various elements, regions, sections, etc. and are also not intended to be limiting. Where possible, like terms refer to like elements throughout the description. A plurality of different structural components may be utilized to implement the handle of the present disclosure. Furthermore, and as described in subsequent paragraphs, the specific mechanical configurations illustrated in the drawings are intended to exemplify embodiments of the present disclosure and that other alternative mechanical configurations are possible.

"Media" or "media sheet" refers to a material that receives a printed image or, with a document to be scanned, a material containing a printed image. The media is said to move along a media path, a media branch, and a media path extension from an upstream location to a downstream location as it moves from the media trays to the output area of the imaging system. For a top feed option tray, the top of the option tray is downstream from the bottom of the option tray. Conversely, for a bottom feed option tray, the top of the option tray is upstream from the bottom of the option tray. As used herein, the leading edge of the media is that edge which first enters the media path and the trailing edge of the media is that edge that last enters the media path. Depending on the orientation of the media in a media tray, the leading/ trailing edges may be the short edge of the media or the long edge of the media, in that most media is rectangular. As used herein, the term "media width" refers to the dimension of the media that is transverse to the direction of the media path. The term "media length" refers to the dimension of the media that is aligned to the direction of the media path. "Media process direction" describes the movement of media within the imaging system, and is generally means from an input toward an output of the imaging device.

FIG. 1 illustrates an example imaging device 10 atop three example option assemblies 50. Imaging device 10 has a housing 20 having a front 22, a first side 24, a second side 26, a rear 28, a top 30 and a bottom 32 and into which a removable media tray 100A is slidably inserted. Option assembly 50 has a housing 65 having a front 66, first and second sides 67, 68, a rear 69, a top 70 and a bottom 72 and into which a removable media tray 100B is slidably inserted. A user interface 40 comprising a display 42 and a key panel 44 may be located on the front 22 of housing 20. Using the user interface 40, a user is able to enter commands and generally control the operation of the imaging device 10. For example, the user may enter commands to switch modes (e.g., color mode, monochrome mode), view the number of images printed, take the imaging device 10 on/off line to perform periodic maintenance, and the like. A media output area 38 for receiving printed media is provided in the top 30. A multipurpose input tray 88 folds out from the front of the removable media tray 100A and may be used for handling envelopes, index cards or other media for which only a small number of media will be printed. The multipurpose tray 88 may also be incorporated into front 22 of housing 20 rather than being incorporated into removable media tray 100A. Hand grips 34, 74 are provided in several locations on housings 20, 65, respectively, such as on sides 24, 26, 67, 68. Also, ventilation openings, such as vents 36 are provided on imaging device 10 such as those shown on first side 24.

Option assemblies 50 may be removed or added to the stack. As each option assembly 50 is added, the media path is extended. The option assemblies 50 are stackable allowing one or more option assemblies 50 to be used with a single imaging device 10 that is typically positioned on top of the uppermost option assembly 50 in the stack. Latches 76 are provided on each option assembly 50 to secure it to either imaging device 10 or a superior option assembly 50 in the stack.

Each removable media tray 100A, 100B is sized to contain a stack of media sheets that will receive color and/or monochrome images. Typically, each removable media tray 100B in option assemblies 50 may contain a different type of media such as letterhead or a different size such as A4 or a larger quantity of the same media type that is found in the removable media tray 100A integrated into imaging device 10. Each removable media tray 100A, 100B may be sized to hold the same number of media sheets or may be sized to hold different quantities of media sheets. Example media sizes include but are not limited to A6, 8½"×11", A4, and 8½"×14". In some instances, the removable media tray 100A found in imaging device 10 may hold a lesser, equal or greater quantity of media than a removable media tray 100B found in an option assembly 50. As illustrated, removable media trays 100A, 100B are each sized to hold approximately 550 pages of 20 pound media which has a media stack height of about 59 mm.

Figure 2:
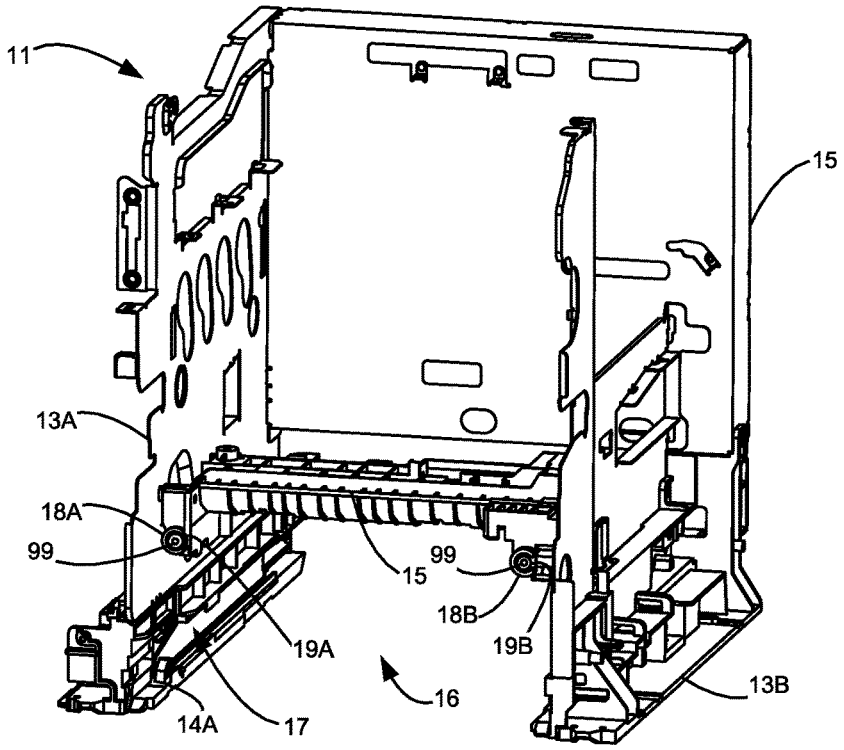
FIGS. 2-3 are right and left perspective illustrations of a frame for the imaging device of FIG. 1.
Figure 3:
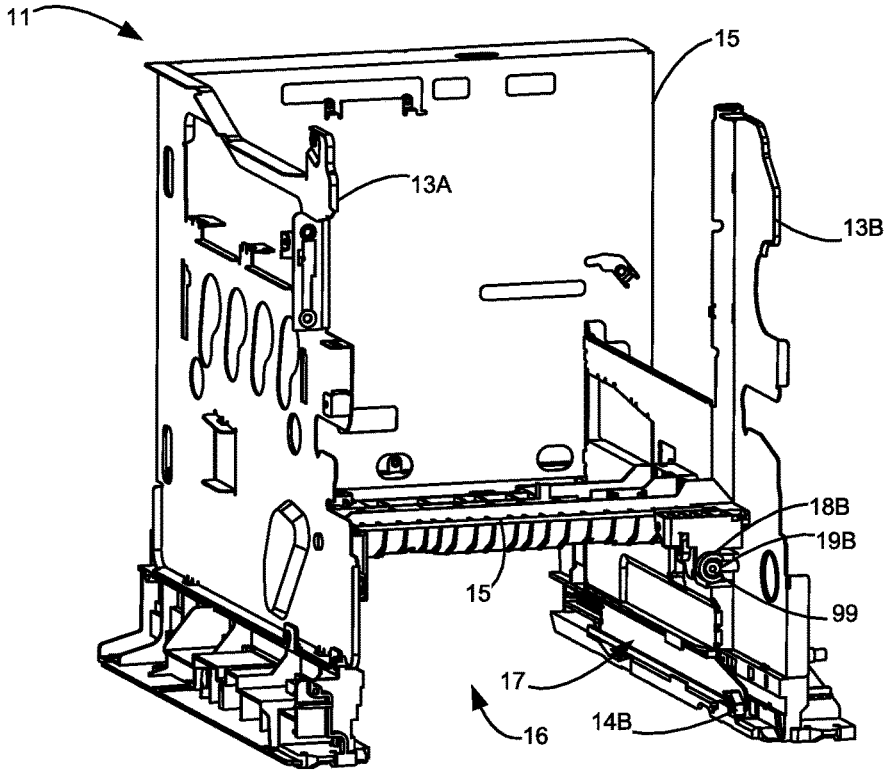

Referring to FIGS. 2-3, housing 20 of imaging device 10 is mounted on a frame 11 consisting of a front member 12 attached to side members 13A, 13B that are in turn attached to rear member 15. Front member 12 and side members 13A, 13B form an opening 16 into which removable media tray 100A is inserted. The open bottom of frame 11 allows media to be received from the inferior option assemblies 50. Channels 17 are provided on side members 13A, 13B for guiding removable media tray 100A into opening 16 during insertion and removal. At least one magnet mount is provided adjacent to opening 16. As shown, two magnet mounts 18A, 18B, are provided on front member 12 adjacent to each of side members 13A, 13B. Magnets 19A, 19B are mounted in mounts 18A, 18B, respectively. Surfaces 14A, 14B are provided on side members 13A. 13B adjacent the opening 16 and are used in conjunction with the operation of handle assembly 200. Surfaces 14A, 14B are also referred to as release surfaces 14A, 14B.

Figure 4:
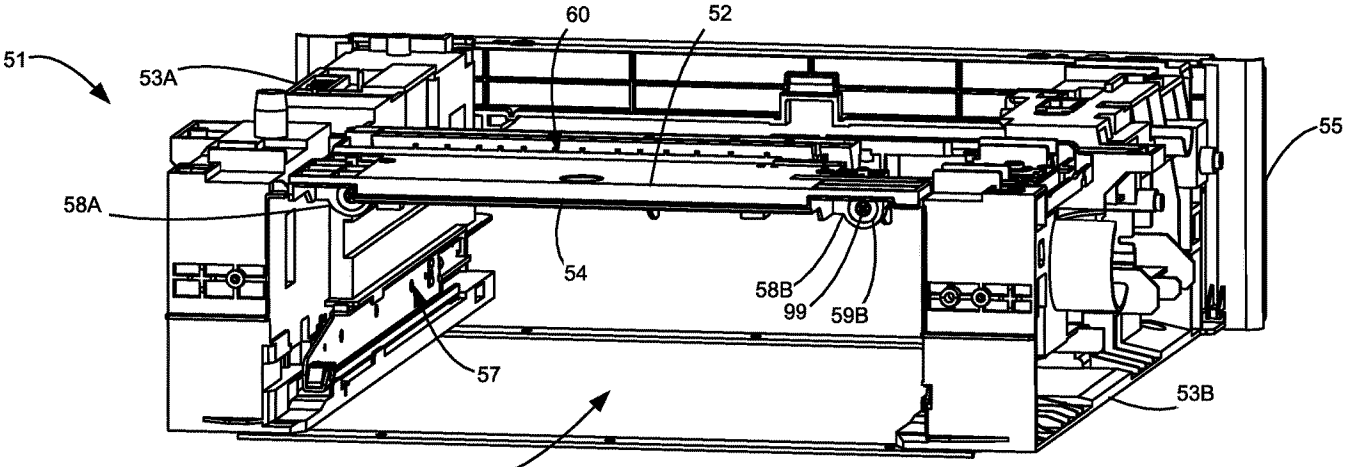
FIGS. 4-5 are right and left perspective illustrations of a frame for the option assemblies of FIG. 1.
Figure 5:
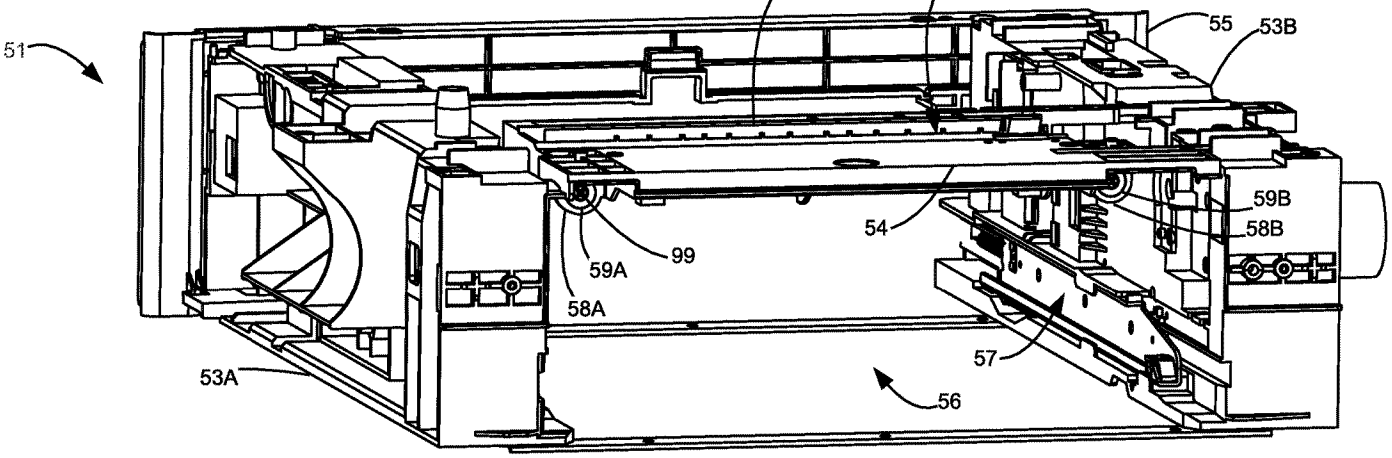

Referring to FIGS. 4-5, housing 65 of option assembly 50 is mounted on a frame 51 consisting of a front member 52 attached to side members 53A, 53B that are in turn attached to rear member 55. Front member 52 and side members 53A, 53B form an opening 56 into which removable media tray 100B is inserted. Channels 57 are provided on each of side members 53A, 53B for guiding removable media tray 100B into opening 56 during insertion and removal. Slot 60 in front member 52 and the open bottom 72 of housing 65 along with a slot 146 provided in removable media tray 100B (see FIG. 9) allow for the feeding of media through each option assembly 50. At least one magnet mount is provided adjacent to opening 56. As shown, two magnet mounts 58A, 58B, are provided on front member 52 adjacent to each side member 53A, 53B, respectively. Magnets 59A, 59B are mounted in mounts 58A, 58B, respectively. A front surface 54 of front member 52 adjacent the opening 56 acts as a release surface 54 used in conjunction with the operation of handle assembly 300.

Referring to FIG. 14, a schematic illustration of common features found in both imaging device 10 and each option assembly 50 is shown. Provided in each imaging device 10 and in each option assembly 50 is a pick mechanism 90 including pick roll 91 for moving a media sheet S from the media stack M. Pick mechanism 90 is typically mounted with imaging device 10 and option assembly 50 above the media stack M to pick the topmost media sheet S. Other mounting arrangements for pick mechanism 90 may also be used. Also provided is one or more drive motors 92 for powering the pick mechanism 90. Further included in imaging device 10 and option assemblies 50 are one or more media sensors 94 for determining when media is present in the tray, the size of the media, type of media and/or the location of the leading and trailing edges of the media. A media dam 140 is provided in removable media trays 100A, 100B, and is used to direct the picked media sheet S into the media path. One or more feed roll pairs 148 may be provided to assist with media feeding in both imaging device 10 and option assemblies 50. Feed roll pair 148 may be driven by drive motor 92 or another motor. A latch L comprises a plate PL shown mounted on front panel 110 of removable media trays 100A. 100B and magnet MG mounted on frame 11, 51. Because the pick force FP drives the media sheet S into the media dam 140, the latching force FL provided by latch L needs to exceed the pick force FP so that the removable media tray being used—either removable media tray 100A or 100B as the case may be—remains closed and the media sheet S is deflected into the media path. The term "pick force" also includes the force applied when the pick drive motor is in a stall condition which would be the highest pick force applied to removable media tray 100A or 100B.

Figure 6:
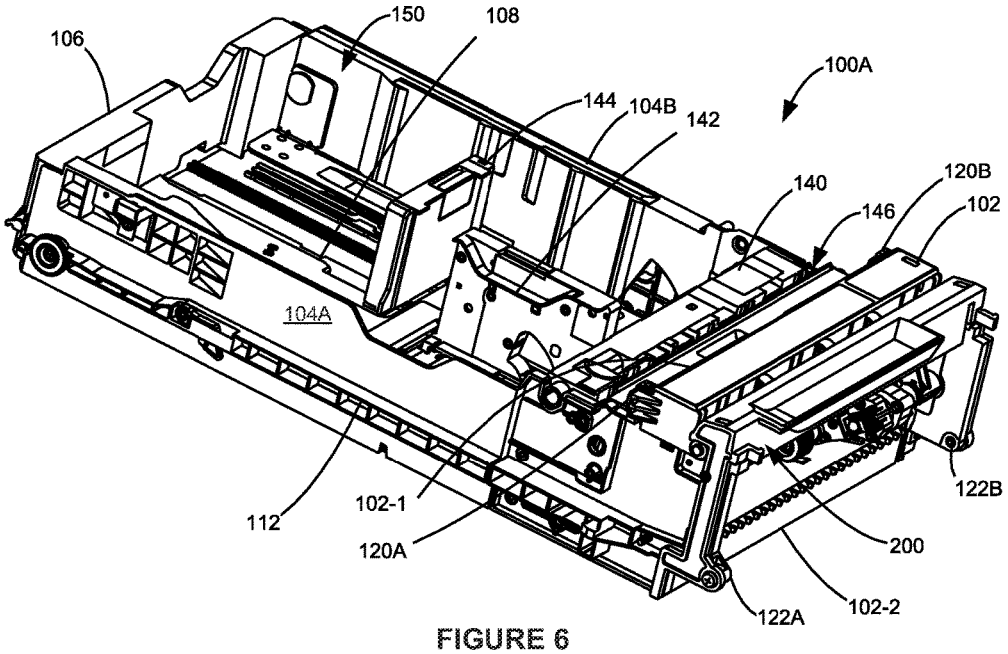
FIGS. 6-7 are left and right side perspective illustrations of a removable media tray having an example embodiment of a low-actuation force handle of the present disclosure.
Figure 7:
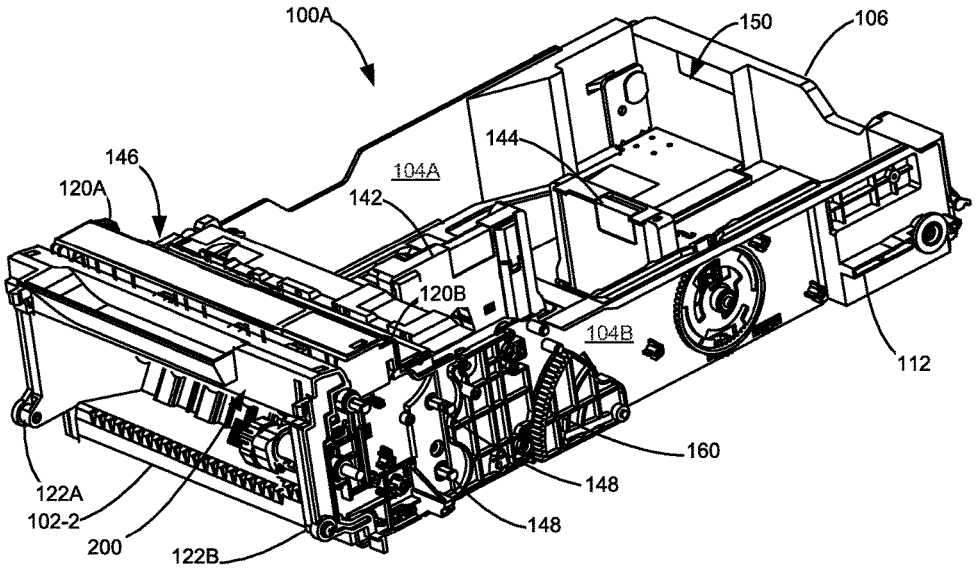
Figure 8:
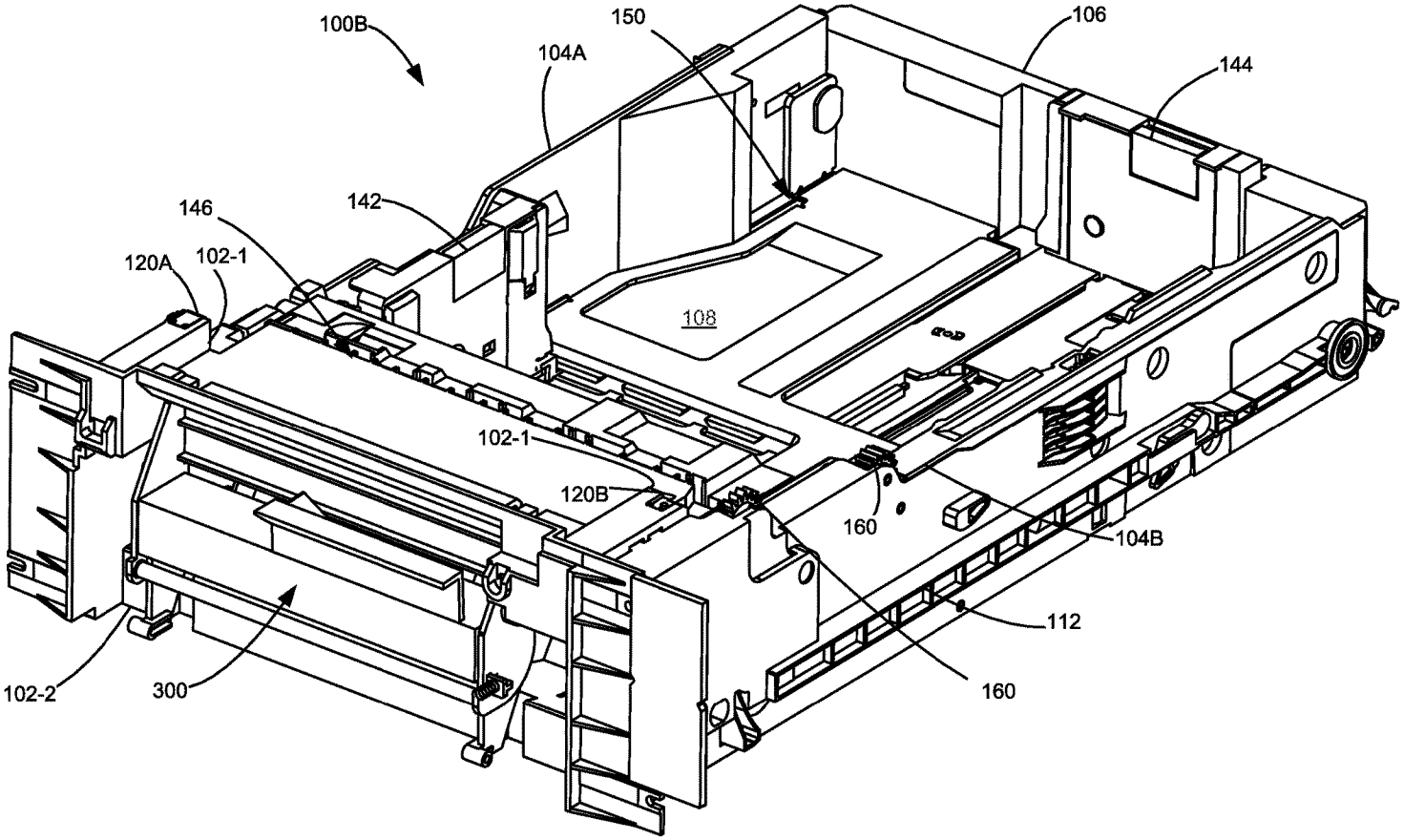
FIGS. 8-9 are right and left side perspective illustrations of a removable media tray having a second example embodiment of a low-actuation force handle of the present disclosure.
Figure 9:
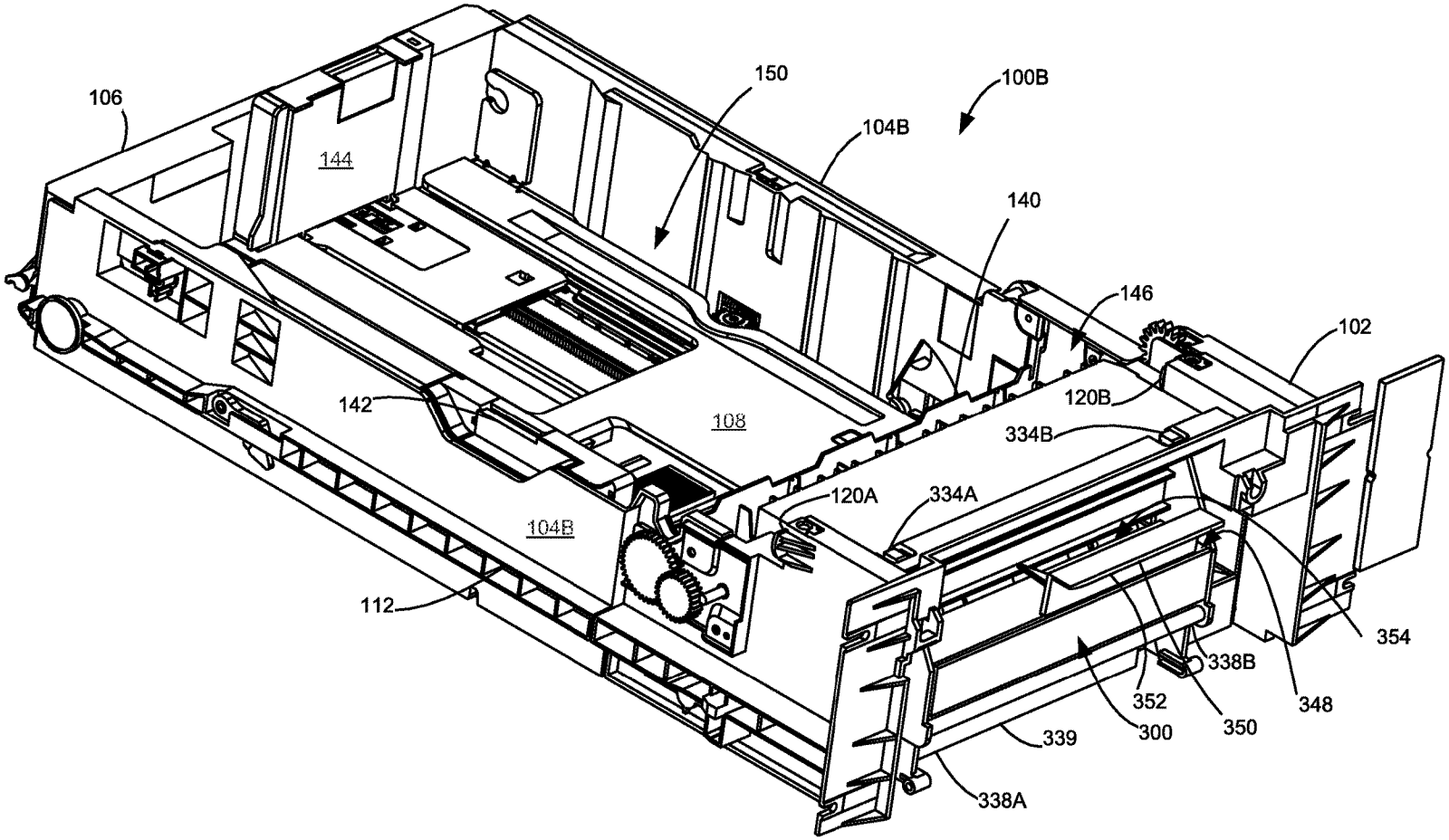

Referring to FIGS. 6-7 where removable media tray 100A is shown and FIGS. 8-9 where removable media tray 100B is shown, front panel 110 has been removed to show the handles 200, 300. Removable media trays 100A, 100B may have the same or similar features having the same or similar reference numbers. As explained later, removable media trays 100A. 100B differ primarily in the handle provided. Removable media tray 100A illustrates the use of a single-link handle 200 while removably input tray 100B shows a double-link handle 300. Each handle 200, 300 allows a user to provide less than 22.2 N of actuation force to open its respective removable media tray and overcome a latching force FL typically greater than 44.4 N in magnitude.

Removable media trays 100A, 100B each have a front wall 102, side walls 104A, 104B, a rear wall 106, and a bottom 108. A cover panel 110 is attached to front wall 102 by fasteners 99 (See FIG. 13). Rails 112 are provided on side walls 104A, 104B of removable media trays 100A, 100B and are received into respective channels 17, 57 in frames 11, 51. At least one plate is provided on each of removable media trays 100A, 100B. Two plates 120A, 120B, made of a ferromagnetic material, such as steel, are shown positioned on the front wall 102 of removable media trays 100A, 100B. Plates 120A, 120B are shown mounted on an inner surface 102-1 of front wall 102. For removable media tray 100A, plates 120A, 120B are aligned with magnets 19A, 19B, respectively, mounted in frame 11. For removable media tray 100B, plates 120A, 120B are aligned with magnets 59A, 59B, respectively, mounted in frame 51. For removable media tray 100A, provided on a front surface 102-2 of front wall 102 are a pair of spaced, aligned mounts 122A, 122B. Handle 200 of the present disclosure is pivotally mounted to the aligned and spaced apart mounts 122A, 122B and is positioned between cover panel 110 and front wall 102. For removable media tray 100B, handle 300 of the present disclosure is positioned between cover panel 110 and front wall 102 and is pivotally mounted to cover panel 110 (see FIG. 12). FIGS. 8-9 illustrate the relationship between handle 300 and the outer surface 102-2 of front wall 102 of removable media tray 100B.

Provided in each removable media tray 100A, 100B is the media dam 140, and one or more adjustable media restraints, such as a side restraint 142 and a rear restraint 144, to accommodate for different media widths and lengths. Rearward of a front wall 102 and media dam 140 is media storage area 150 for media to be fed to imaging device 10. Media storage area 150 is generally defined by front wall 102 and side walls 104A, 104B and bottom 108. Slot 146 is provided for feeding media through each of removable media trays 100A, 100B from an inferior removable media tray. Feed roll pair 148 is contained within front wall 102 (see FIG. 7). As illustrated, rear wall 106 encloses media storage location 150. Alternate embodiments of removable media trays 100A or 100B may not include a rear wall 106. Media storage area 150 may be open or enclosed.

Figure 10:
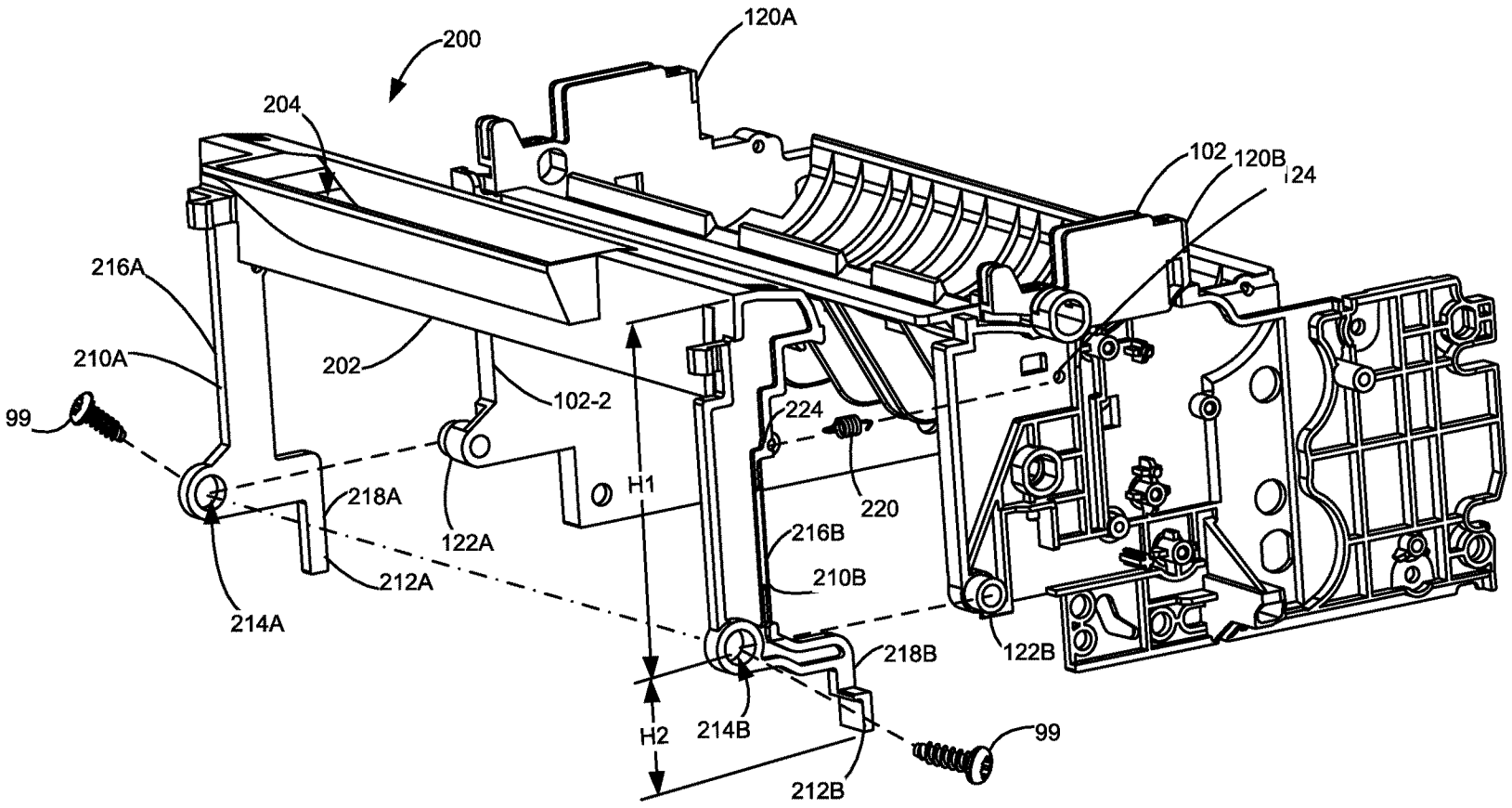
FIG. 10 is an exploded perspective view of the example embodiment of a low-actuation force handle of FIGS. 6-7.
Figure 11A:
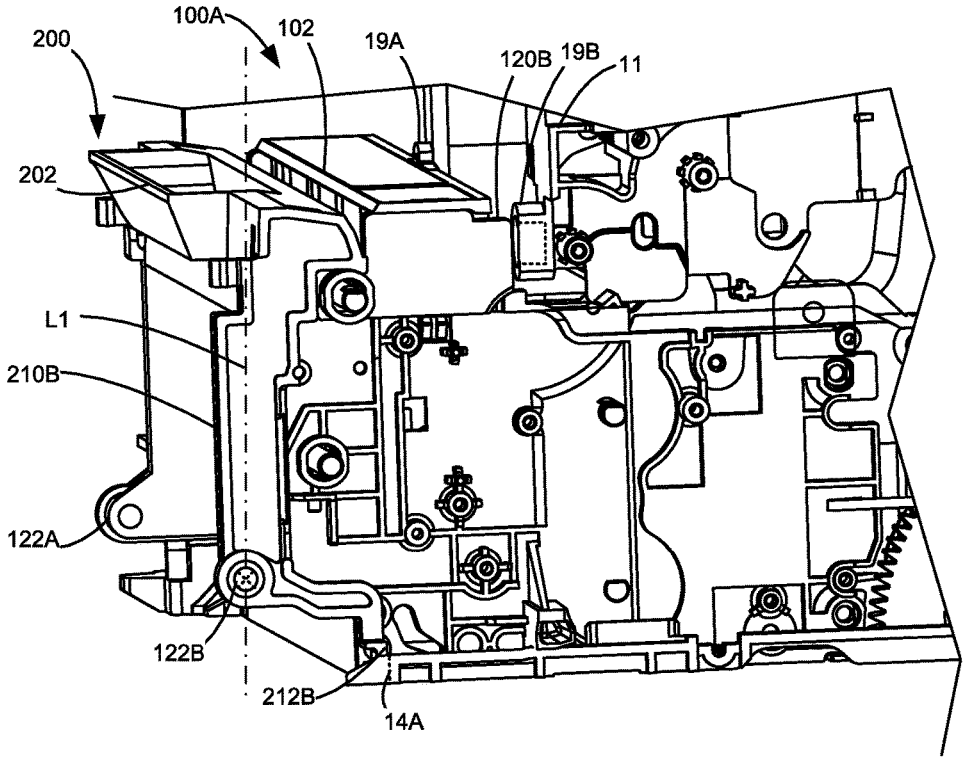
FIGS. 11A-11B are perspective illustrations of the operation of the example embodiment of a low-actuation force handle of FIG. 10 when opening a removable media tray.
Figure 11B:
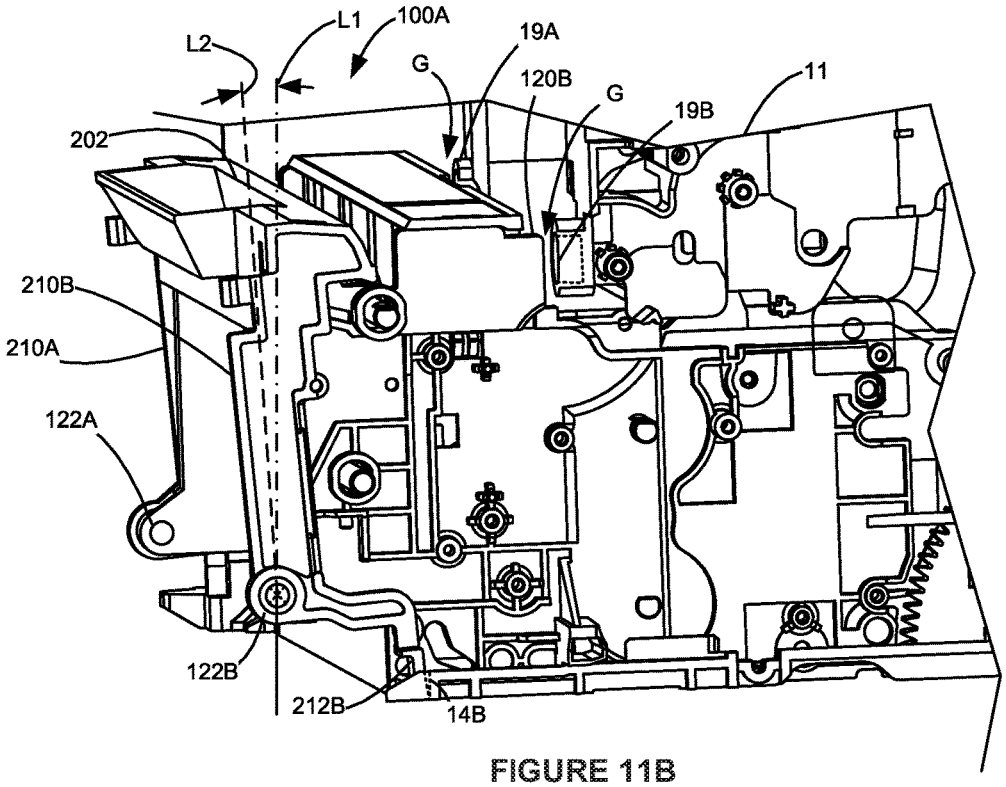

Details of handle 200 are illustrated in FIGS. 10, 11A and 11B. Handle 200 includes a finger bar 202 transversely extending across a portion of the outer surface 102-2 of the front wall 102. Finger bar 202 may be provided with a recess 204 into which the fingertips of a user are placed when using handle 200. At least one link depends from the finger bar 202. Two links 210A, 210B are shown. Links 210A, 210B have free ends 212A, 212B that will be adjacent to the release surfaces 14A, 14B, respectively when removable media tray 100A is inserted into frame 11. Links 210A, 210B are pivotally mounted to the aligned mounts or pivots 122A, 122B, which are shown as cylindrical bosses 122A, 122B, extending from the front surface 102-2 of front wall 102. Openings 214A, 214B, that are aligned with one another, are provided in each of links 210A, 210B, respectively, and are sized to allow bosses 122A, 122B to be received therein. Fasteners 99 are inserted into openings 214A, 214B to rotatably affix links 210A, 210B to bosses 122A, 122B, respectively, and pivot around bosses 122A, 122B.

Links 210A, 210B, each having a first arm portion 216A, 216B, extending between the mounts 122A, 122B, and the finger bar 202, respectively, and, a second arm portion 218A, 218B extending from the mounts 122A, 122B to the free ends 212A, 212B of the links 210A, 210B, respectively. The first arm portions 216A, 216B, each having a vertical height H1 and the second arm portions 218A, 218B having a vertical height H2. However, second arm portions 218A, 218B may have different heights as explained with reference to FIGS. 19A, 19B. The ratio or mechanical advantage of H1:H2 in one embodiment is 3:1 or greater to achieve an actuation force FA that is in the range of 18 N to no more than 22.2 N. The ratio H1:H2 may be in the range of approximately 3:1 to 3.8:1. Another way of stating the requirement for the mechanical advantage that is needed is to divide the latching force FL that is needed for a given removable media tray design to remain closed when the pick force is at the maximum design limit, such as the pick drive motor stall force by 22.2 N. For example, should the latching force FL needed be 60 N, the mechanical advantage needed would be 60/22.2 or a ratio of H1:H2 of 2.7:1. Height H1 may be in the range of about 85 mm to about 95 mm, and H2 may be in the range of about 25 mm to about 30 mm. For these ranges of heights, the ratio H1:H2 may be in the range of approximately 3:1 to 3.8:1. The magnitude of heights H1 and H2 are a matter of design choice. A biasing member 220, such as spring 220, may be attached to one of the links, link 210B as shown, and the front surface 102-1 of front wall 102 for biasing handle 200 in a first position. Openings 124, 224 provided in front wall 102 and link 210B, respectively, may be used to attach spring 220.

Referring to FIGS. 11A-11B, removable media tray 100A is shown in closed and open positions, respectively, with respect to frame 11. In FIG. 11A, handle 200 is in a first or vertical position as indicated by line L1. Plate 120B abuts magnet 19B. Plate 120A would also abut magnet 19A but is obscured by front wall 102. Free end 212B of link 210B is adjacent to or may abut release surface 14B on frame 11. Free end 212A of link 210A is similarly positioned by release surface 14A but is obscured by front wall 102 in these figures. In FIG. 11B, handle 200 has been pivoted or rotated about mounts 122A, 122B by a user supplied actuation force that is 22.2 N or less and has moved to a second or released position as indicated by line L2. A gap G now exists between plates 120A. 120B and their respective magnets, 19A, 19B and removable media tray 100A has been moved to an open position and may be slid from frame 11. The pivoting of handle 200 forces the free ends 212A, 212B of links 210A, 210B, respectively, against respective release surfaces 14A, 14B on frame 11 to move removable media tray 100A away from frame 11. This action of handle 200 applies a release force that is greater than the latching forces provided by magnets 19A, 19B and respective plates 120A, 120B opening removable media tray 100A. Handle 200 rotates about four degrees between its first and second positions. We have found that this amount of rotation provides a consistent tactile feedback or feeling to the user.

Figure 12:
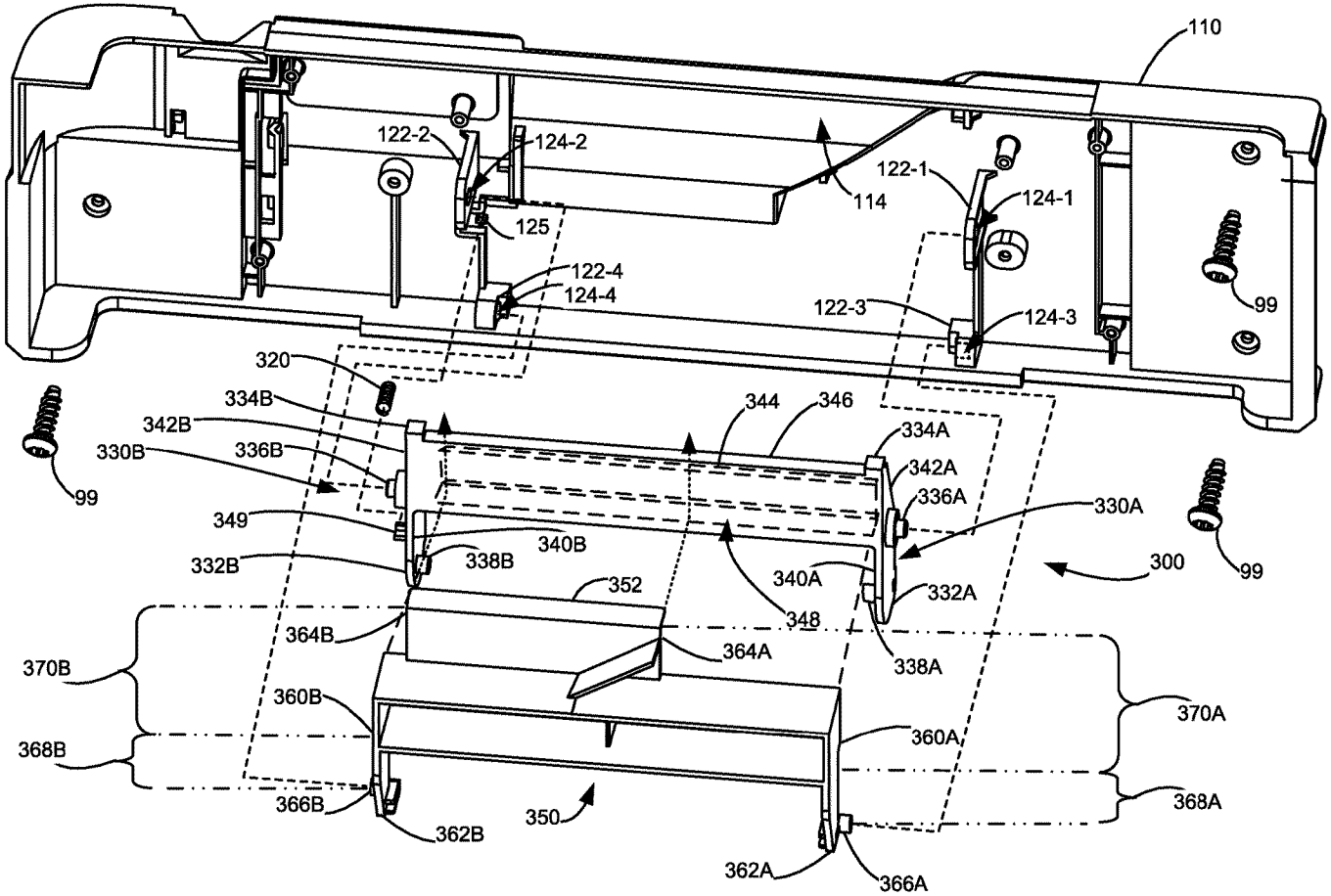
FIG. 12 is an exploded perspective view of the second example embodiment of a low-actuation force handle of FIGS. 8-9.
Figure 13A:
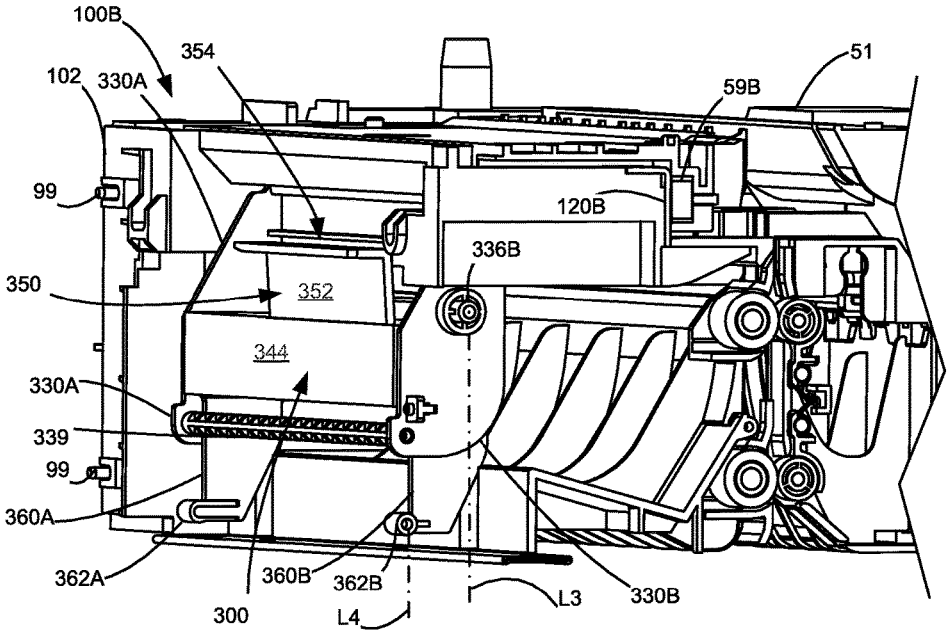
FIGS. 13A-13B are perspective illustrations of the operation of the second example embodiment of the low-actuation force handle of FIG. 12 when opening a removable media tray.
Figure 13B:
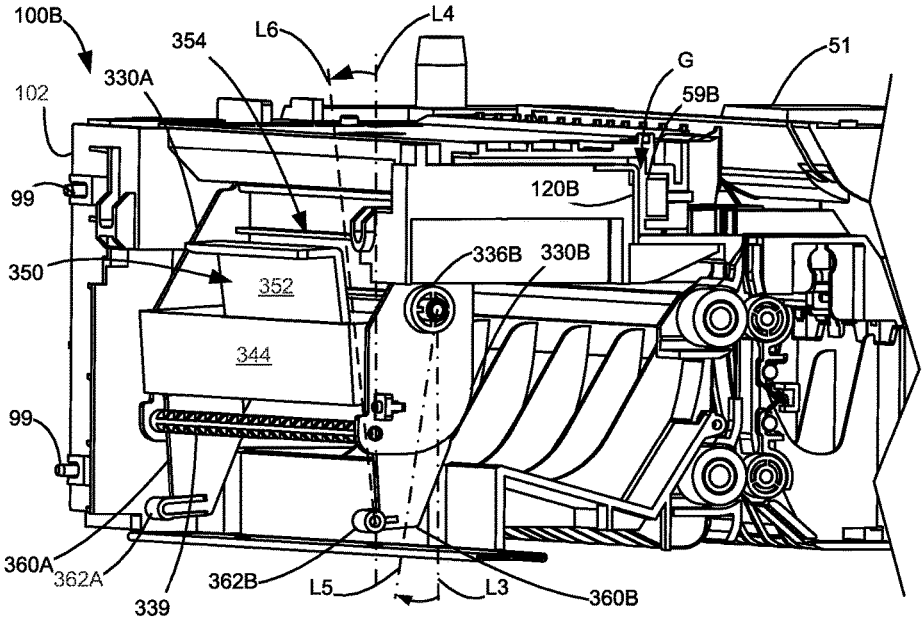

Details of handle 300 and its attachment to front panel 110 of removable media tray 100B are illustrated in FIGS. 12, 13A and 13B. Handle 300 is mounted to front panel 110 having an opening 114 therein into which handle 300 is inserted. Fasteners 99 are used to secure front panel 110 to front wall 102 of removable media tray 100B (see also FIG. 13A). The rear surface 110-1 of front panel 110 is provided with two pairs of aligned spaced apart mounts 122-1, 122-2 and 122-3, 122-4 used to pivotally mount the members of handle 300 to front panel 110 of removable media tray 100B. Mounts 122-1, 122-2 are positioned above the bottom of front panel 110 while mounts 122-3, 122-4 are positioned at or near the bottom of front panel 110. Mounts 122-1, 122-2 are referred to as upper mounts while mounts 122-3, 122-4 are referred to as the lower mounts.

Handle 300 includes at least one first member, a left and a right first member 330A, 330B are shown. Left and right is determined as if viewing from the front of removable media tray 100B or imaging device 10. Left and right first members 330A, 330B have a first (bottom) end 332A, 332B and a second (top) end 334A, 334B. Mounts 336A, 336B, shown as cylindrical bosses 336A, 336B are provided on left and right first members 330A, 330B, respectively, intermediate the ends. As shown, mounts 336A, 336B are positioned approximately midway between the two ends and serve as pivots. Mounts 336A, 336B are received in openings 124-1, 124-2 provided in upper mounts 122-1, 122-2, respectively, on front panel 110. Also, inwardly depending from left and right first members 330A, 330B are left and right pivot members 338A, 338B shown positioned adjacent to first ends 332A, 332B. Left and right first members 330A, 330B have first arm portions 340A, 340B extending between the pivot members 338A, 338B and the upper mount 336A, 336B, respectively, and second arm portions 342A, 342B extending between the upper mounts 336A, 336B and the second ends 334A, 334B, respectively. The second arm portion has a vertical height H5 and the first arm portion has a vertical height H6 (see FIG. 17A). When two first members are used, they may be interconnected. Left and right first members 330A, 330B are shown interconnected by first and second cross members 344, 346 defining a space or opening 348. Left and right pivot members 338A, 338B may also be portions of a single transverse pivot bar 339 as shown in FIG. 9.

Handle 300 further includes a second member 350 that nests inside of first member 330. Second member 350 includes a finger bar 352 and at least one link depending therefrom. Two links 360A, 360B are shown at respective ends of second member 350. Finger bar 352 transversely extends across a portion of the outer surface 102-1 of front wall 102 and across a portion of first member 350. Links 360A, 360B have free ends 362A, 362B adjacent to which are located mounts 366A, 366B, respectively, and second ends 364A, 364B at finger bar 352. Mounts 366A, 366B are shown as cylindrical bosses 366A, 366B. Mounts 366A. 366B are pivotally received in openings 124-3, 124-4, respectively, provided in lower mounts 122-3, 122-4, respectively on front panel 110. Links 360A, 360B have a first arm portion 368A, 368B extending between the lower mount 366A, 366B, and the location at which the links 360A, 360B contact pivot member 338A, 338B, respectively, on the first members 330A, 330B, and a second arm portion 370A, 370B extending from the pivot member 338A, 338B to the second end 364A, 364B of the links 360A, 360B, respectively, (see also FIG. 17A). As shown, links 360A, 360B, and finger bar 352 are integrally molded as a single piece. Finger bar 352 passes through opening 348 as indicated by the two dashed and angled arrows and is positioned in front of second cross member 346 when removable media tray 100B is viewed from the front (or back of second cross member 346 as viewed in FIG. 12).

First and second members 330, 350 are each pivotable between respective first and second positions, respectively. A biasing member 320 may be attached to front panel 100 at mount 125 and to first member 330 at mount 349, shown as a cruciform boss 349, to bias first and second members 330, 350 into their respective first positions (vertical positions). In their respective first positions, first and second member 330, 350 are substantially vertical. When first and second members 330, 350 are mounted on front panel 110, a recess 354 (see FIG. 9) is formed between finger bar 352 and first member 330 for receiving fingertips of a user wishing to move removable media tray 100B into an open position.

Referring to FIGS. 9, and 13A-13B, the action of handle 300 during opening is shown. In these figures front panel 110 has been removed in order to see the rotation or pivoting of the left and right first members 330A, 330B and second member 350 in handle 300. In FIG. 13A, removable media tray 100B is in a closed position. Plate 120B abuts magnet 59B on frame 51. Plate 120A also abuts magnet 59A but is obscured by front wall 102. Left and right first members 330A, 330B and second member 350 of handle 300 are shown in their respective first or vertical positions as indicated by lines L3, L4, respectively. Top ends 334A, 334B (see FIG. 9) of left and right first members 330A, 330B are adjacent to or may abut release surface 54 on frame 51. In FIG. 11B, second member 350 has been pivoted or rotated about mounts 122-3, 122-4 by a user-supplied actuation force that is 22.2 N or less and has moved to a second or released position as indicated by line L6. Links 360A, 360B apply a rotating force to pivot bar 339 (or to pivot members 338A, 338B) causing left and right first members 330A, 330B to rotate about mounts 336A, 336B with top ends 334A, 334B applying a release force against release surface 54 of frame 51 moving removable media tray 100B away from frame 51. A gap G now exists between plates 120A, 120B and their respective magnets, 59A, 59B. The action of handle 300 applies a release force that is greater than the latching forces provided by magnets 59A, 59B and respective plates 120A, 120B opening removable media tray 100B. Left and right first members 330A, 330B and second member 350 rotate about four degrees.

Referring again to FIG. 14, a schematic illustration of the latching and pick forces is shown. Pick mechanism applies a pick force FP against media dam 140. Latch L having plate PL and magnet MG provides a counteracting latching force FL that is greater than the pick force FP. Typically, the pick force FP varies in the range of about 8 N to about 15 N so that different media types can be reliably picked. The latching force FL is typically designed to be greater than the largest pick force expected FPmax. i.e., the pick drive motor maximum stall force that in one embodiment is 45 N. The latching force FL in one instance is greater than 45 N.

Referring now to FIG. 15, the operation of handle 200 is schematically shown using a single magnet 19 and plate 120. In FIG. 15, removable media tray 100A is closed with magnet 19 and plate 120 providing a latching force FL. A user-supplied actuation force FA is applied to finger bar 202 attached to link 210 and a release force FR is applied to release surface 14. First arm 216 of link 210 has a vertical height H1 measured between finger bar 202 and mount 122. Second arm 218 has a vertical height H2 measured between mount 122 and the free end 212 of link 210. Handle 200 acts as a force multiplier for the actuation force FA as described in Eq. 1.

$$FR=FA(H1/H2) \qquad \text{Eq. 1}$$

where 18 N≤FA≤22.2 N and FR≥FL≥FPmax.

Referring now to FIGS. 16A-16B, the operation of handle 200 is schematically shown using a dual magnets and plates. In FIG. 16A, removable media tray 100A is closed with magnet 19A and plate 120A providing a first latching force FL1. In FIG. 16B, magnet 19B and plate 120B providing a second latching force FL2. A user-supplied actuation force FA is applied to finger bar 202 attached to links 210A, 210B and a first and second release force FR1, FR2 is applied to release surfaces 14A, 14B, respectively, via links 210A, 210B. First arms 216A, 216B each have a vertical height H1 measured between finger bar 202 and mounts 122A. 122B, which are aligned as indicated by line L7. Second arms 218A, 218B each have a vertical height 112 measured between mount 122A, 122B and the free ends 212A, 212B. Each of the links 210A, 210B provide substantially identical release forces. Handle 200 again acts as a force multiplier for the actuation force FA as described in Eqs. 2-4.

$$FR1=FA(H1/H2) \quad \text{Eq. 2}$$

$$FR2=FA(H1/H2) \quad \text{Eq. 3}$$

$$FR_{total}=FR1+FR2=FA(H1/H2)\times 2 \quad \text{Eq. 4}$$

where 18 N≤FA≤22.2 N and FR1+FR2≥FL≥FPmax.

Figure 17A:
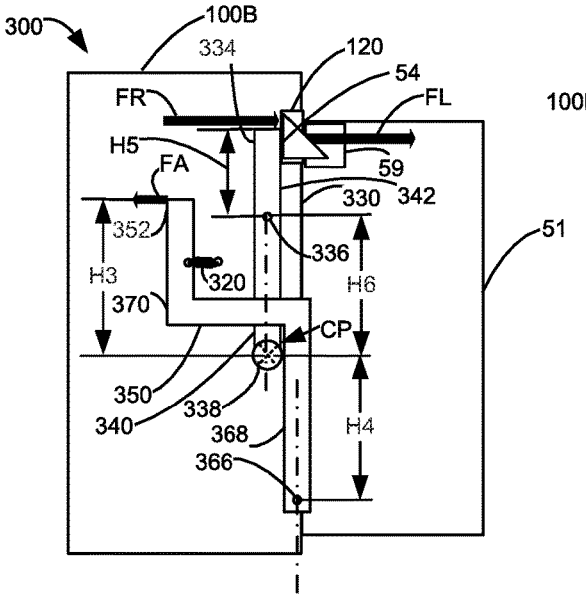
FIGS. 17A-17B are schematic illustrations of the release forces provided by the example handle of FIG. 12 utilizing a two member handle assembly to open a removable media tray.
Figure 17B:
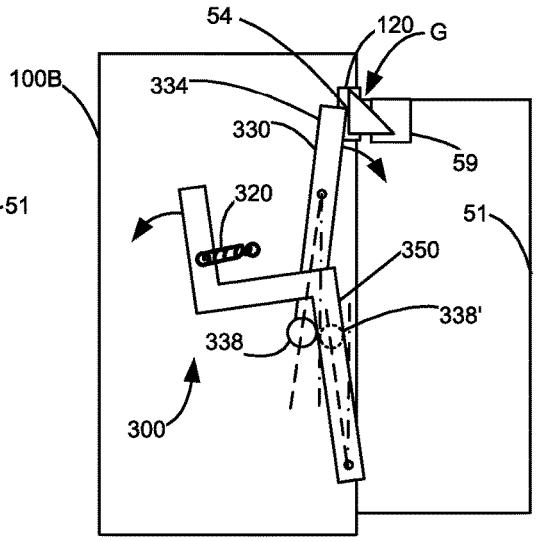

FIGS. 17A-17B schematically depict the operation of handle 300 used with removable media tray 100B utilizing a single magnet and single plate. In FIG. 17A, the actuation force FA is applied by a user to finger bar 352 of second member 350 causing second member 350 to pivot about lower mount 336 and contact pivot member 338 on first member 330 at the indicated contact point CP. The contact between second member 350 and first member 330 at pivot member 338 pivots first member 330 about upper mount 336 in a direction opposite that of second member 330. As shown in FIG. 17B, pivot member 338' may be provided on second member 350 instead of on first member 330. Second member 350 pivots, the top end 334 of first member 330 applies a release force FR against release surface 54 separating removable media tray 100B from frame 51 and opening a gap G between plate 120 and magnet 59. The second arm portion 370 of second member 350 has a first vertical height H3 measured between finger bar 352 and the contact point CP with pivot member 338. The first arm portion 368 of second member 350 has a second vertical height 114 measured between the contact point CP and lower mount 366. Second arm portion 342 of first member 330 has a vertical height H5 measured between top end 332 and upper pivot 336 and first arm portion 340 of first member 330 has a vertical height H6 measured between upper pivot 336 and the contact point CP. Handle 300 also acts as a force multiplier for the actuation force FA as described in Eq. 5.

$$FR=FA(H3+H4/H4)(H5/H6) \quad \text{Eq. 5}$$

where 18 N≤FA≤22.2 N and FR≥FL≥FPmax.

Handle 300 shown in FIG. 12, operates in a similar fashion but provides a first and a second release force FR1, FR2 to overcome the first and second latching forces FL1, FL2. Handle 300 of FIG. 12 also acts as a force multiplier for the actuation force FA and provides a first and second release force FR1, FR2 to release surface 54 as described in Eqs. 6-8.

$$FR1=FA((H3+H4)H4))\times(H6/H5) \quad \text{Eq. 6}$$

$$FR2=FA((H3+H4)/H4))\times(H6/H5) \quad \text{Eq. 7}$$

$$FR_{total}=FR1+FR2=FA((H3+H4)/H4(H6/H5))\times 2 \quad \text{Eq. 8}$$

where 18 N≤FA≤22.2 N and FR1+FR2≥FL≥FPmax.

Because left and right first members 330A, 330B, and left and right links 360A, 360B are substantially identical, the first and second release forces FR1, FR2 are also substantially identical. With the various embodiments shown, the release force FR is at least 44.4 N.

Figure 18:
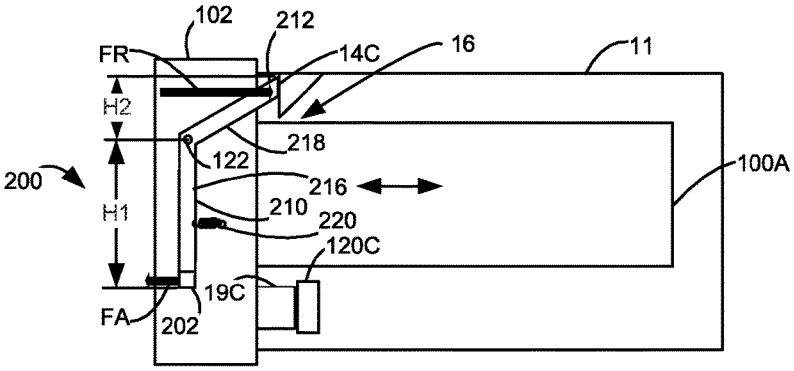
FIG. 18 is a schematic depiction of another alternate example embodiment of the handle of FIG. 10 used in an inverted position on a removable media tray.
Figure 19A:
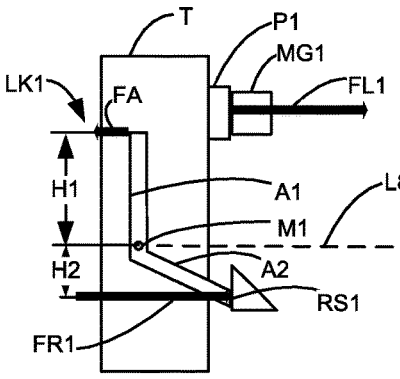
FIGS. 19A-19B are schematic depictions of a still further alternate example embodiment of the handle of FIG. 10 providing two release forces of different magnitudes.
Figure 19B:
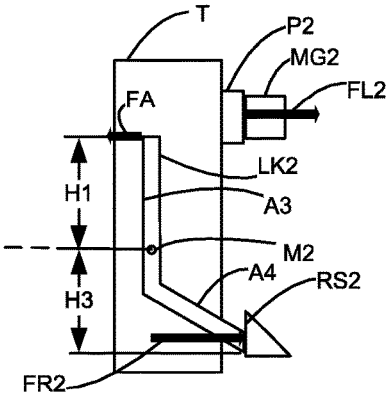

FIGS. 18-19B illustrate alternate embodiments for handle 200. As one of ordinary skill in the art would recognize, similar alternate embodiments may also be provided for handle 300. In FIG. 18, handle 200 has been inverted. Finger bar 202 is positioned near the bottom of removable media tray 100A while the free end 212 of link 210 now abuts a release surface 14C positioned adjacent the top of opening 16 in frame 11. Mount 122 for link 210 has also been raised to be nearer the top of front wall 102. Also, magnet 19C is shown in an alternate mounting position on the front wall 102 of removable media tray 100A and aligned with plate 120C provided on frame 11. The positions of plate 120C and magnet 19C and release surface 14C have also been reversed on those similar elements shown on frame 11 in FIG. 15. A similar arrangement may be done for handle 300.

FIGS. 19A-19B illustrate a still further embodiment where the release forces FR1, FR2 are not equal. For example, gears 160 provided on removable media trays 100A, 100B, as shown in FIGS. 7 and 8, interface with mechanisms mounted on frames 11, 51 and a higher latching force FL and a higher release force may be needed on one side of removable media trays 100A, 100B than on the other. Links LK1, LK2 are pivotally mounted on opposite sides of removable media tray T on mounts M1, M2, respectively, that are aligned as indicated by line L8. Links LK1, LK2 function similarly to those used in handle 200. Plate P1 and magnet MG1 provide a first latching force FL and are mounted near link LK1 while plate P2 and magnet MG2 provide a second latching force FL2 and are mounted near link LK2. Latching force FL1 is illustrated as being greater than latching FL2. Link LK1 acts against release surface RS1 while link LK2 acts against release surface RS2 when a user-supplier actuation force FA is applied. Link LK1 has first and second arms A1, A2 having vertical heights H1 and H2. Link LK2 has first and second arms A3, A4 having vertical heights H1, H3, respectively, where H3 is greater than H2. Because H3 is greater than H2, the mechanical advantage of link LK2 is less and the magnitude of release force FR2 provided by link LK2 is less than the magnitude of release force FR1 provided by link LK1. While FIGS. 19A-19B illustrate adjusting the heights of second arm portions A2, A4, the heights of first arm portions A1, A3, may be adjusted to provide different magnitudes for release forces FR1, FR2.

While handles 200, 300 are shown acting against two magnets provided in frame 11, 51, it would be understood that a single magnet may be used. Handle 200 may be modified to have a single link depending from the finger bar 202 and pivotally mounted to front wall 102. Similarly for handle 300, a single first member and a single second member may be used. Further, handle 300 may be mounted to an outer surface of front wall 102 of removable media tray 100B. First member 330 of handle 300 may be mounted to front panel 110 while second member 350 may be mounted to the outer surface 102-1 of front wall 102 of removable media tray 100B and vice versa.

The foregoing description of several methods and an embodiment of the present disclosure have been presented for purposes of illustration. It is not intended to be exhaustive or to limit the present disclosure to the precise steps and/or forms disclosed, and obviously many modifications and variations are possible in light of the above description. It is intended that the scope of the present disclosure be defined by the claims appended hereto.

What is claimed is:

1. A removable media tray assembly for providing media to an imaging device, the removable media tray assembly comprising:

a housing having an opening therein to receive a removable media tray and a release surface;

the removable media tray having:

a bottom surface for holding media to be fed to the imaging device;

a front wall extending upward from the bottom surface, the front wall having an inner surface and an outer surface having a mount and;

a magnet mounted to one of the housing and the inner surface of the front wall adjacent to the housing opening and a ferromagnetic plate aligned with the magnet and mounted to other of the housing and inner surface of the front wall;

a handle pivotable between a first position and a second position, the handle including:

a finger bar transversely extending across a portion of the outer surface of the front wall; and, a link depending from the finger bar and having a free end adjacent to the release surface, the link pivotally mounted to the mount, the link having a first arm portion extending between the mount and the finger bar and a second arm portion extending from the mount to the free end of the link, the first arm portion having a vertical height H1 and the second arm portion having a vertical height H2, wherein, with the removable media tray received into the housing and the magnet and plate in abutment providing a latching force FL holding the removable media tray in a closed position and which is greater than a stall force of a media feeding motor used to feed the media from the removable media tray, a user-supplied actuation force FA applied to the finger bar pivots the handle toward the second position and the link pivots about the mount with the free end of the link applying a release force FR to the release surface thereby opening the removable media tray and moving the plate and magnet apart where FA≤22.2 N, FL>FA, and FR>FL.

2. The removable media tray assembly of claim 1 further comprising a biasing member attached to the handle for biasing the handle in the first position.

3. The removable media tray assembly of claim 1 wherein FR=FA(H1/H2) and a ratio of H1:H2 is in the range of approximately 3:1 to 3.8:1.

4. A removable media tray assembly for providing media to an imaging device, the removable media tray assembly comprising:

a housing having an opening therein to receive are movable media tray, the housing having:

a release surface; and, a magnet mounted adjacent the opening;

the removable media tray having:

a bottom surface for holding media to be fed to the imaging device;

a front wall extending upward from the bottom surface, the front wall having an inner surface having a ferromagnetic plate aligned with the magnet and an outer surface having a mount:

and, a handle pivotable between a first position and a second position, the handle including:

a finger bar transversely extending across a portion of the outer surface of the front wall; and, a link depending from the finger bar and having a free end adjacent to the release surface, the link pivotally mounted to the mount, the link having a first arm portion extending between the mount and the finger bar and a second arm portion extending from the mount to the free end of the link, the first arm portion having a vertical height H1 and the second arm portion having a vertical height H2;

a biasing member attached to the handle for biasing the handle in the first position, wherein, with the removable media tray received into the housing and the magnet and plate in abutment providing a latching force FL holding the removable media tray in a closed position where FL is greater than a pick force applied the media during feeding to the imaging device, a user-supplied actuation force FA applied to the finger bar pivots the handle toward the second position, the link pivots about the mount applying a release force FR to the release surface opening the removable media tray and moving the removable media tray away from the magnet where 18 N≤FA≤22.2 N, FR=FA(H1/H2) and FR>FL.

5. The removable media tray assembly of claim 4, wherein the mount further comprises a cylindrical boss extending from the front surface of the front wall and the link has an opening therein sized to closely receive the boss.

6. The removable media tray assembly of claim 4 wherein the link pivots through an arc of about four degrees.

7. The removable media tray assembly of claim 4 wherein the finger bar has a recess for receiving a fingertip of a user.

8. The removable media tray assembly of claim 4 wherein:

the magnet comprises a first and a second magnet positioned on the housing adjacent to a left and a right side of the opening;

the latch plate further comprises a first and a second latch plate mounted on the inner surface of the front wall opposite the first and the second magnet, respectively;

the release surface further comprises a first and a second release surface each positioned adjacent to one of a top and a bottom of the opening and the left and right side of the opening, respectively;

the mount further comprises a first and a second mount positioned on the outer surface of the front wall in an aligned, spaced apart relationship; and, the link further comprises a first and second link depending from the finger bar, the first and second links pivotally mounted to the first and second mounts, respectively, with the free end of the first and second links positioned adjacent to the first and second release surfaces, respectively, wherein, with the removable media tray received into the housing and the first and second magnets in abutment with the first and second latch plates, respectively, providing a first and a second latching force FL1, FL2, respectively, holding the removable media tray in a closed position and with a user-supplied actuation force FA applied to the finger bar to pivot the handle toward the second position, the first and second links pivot about the first and second mounts, respectively, to apply a first and a second release force FR1, FR2, to the first and second release surfaces, respectively, to open the tray and move the tray away from the first and second magnets where FR1+FR2>FL1+FL2.

9. The removable tray assembly of claim 8 wherein FL1 is substantially equal to FL2 and FR1 is substantially equal to FR2.

10. The removable tray assembly of claim 8 wherein FL is not equal to FL2 and FR1 is greater than FL1 and FR2 is greater than FL2.

11. A removable media tray assembly for providing media to an imaging device, the removable media tray assembly comprising:

a housing having an opening therein to receive are movable media tray, the housing having:

a release surface; and, a magnet mounted adjacent the opening;

the removable media tray having:

a bottom surface for holding media to be fed to the imaging device;

a front wall extending upward from the bottom surface, the front wall having an inner surface having a ferromagnetic plate aligned with the magnet and an outer surface having an upper mount and a lower mount vertically spaced apart thereon;

and, a handle including a first member and a second member pivotally mounted to the first and second mounts respectively, the first and second members each pivotable between a first position and a second position, respectively;

the first member having a first end, a second end and a pivot member depending from the first end thereof, the first member having a first arm portion extending between the pivot member and the upper mount and having a vertical height H1 and a second arm portion extending between the upper mount and the second end thereof and having a vertical height H2, the second end of the first member positioned adjacent to the release surface;

the second member including:

a finger bar transversely extending across a portion of the outer surface of the front wall; and, a link depending from the finger bar and having a first end pivotally mounted to the lower mount and a second end connected to the finger bar, the link moveable into contact with the pivot member of the first member, the link having a first arm portion extending between the lower mount and the pivot member of the first member and a second arm portion extending from the pivot member to the second end of the link, the first arm portion of the link having a vertical height H3 and the second arm portion having a vertical height H4;

and, a biasing member attached to the second member for biasing the second member in its first position, wherein, with the removable media tray received into the housing and the magnet and plate in abutment providing a latching force FL holding the removable media tray in a closed position where FL is greater than a stall force of a media feeding motor used to feed media from the removable media tray, a user-supplied actuation force FA applied to the finger bar to move the second member from its first position to its second position pivots the second member about the lower mount contacting the pivot member of the first member pivoting the first member about the upper mount from its first position to its second position with the second end of the first member applying a release force FR to the release surface opening the removable media tray and moving the removable media tray away from the magnet where FR>FL, FA≤22.2 N and FR=FA ((H3+H4)/H3)(H1/H2).

12. The removable media tray assembly of claim 11, wherein the first and second mounts each further comprise a cylindrical boss extending from the front surface of the front wall and the first member and the link each has an opening therein sized to closely receive its respective boss.

13. The removable media tray assembly of claim 11, wherein FA≥18 N.

14. The removable media tray assembly of claim 11 wherein the first member and the link each pivot through an arc of about four degrees.

15. The removable media tray assembly of claim 11 wherein the finger bar has a recess for receiving a fingertip of a user.

16. The removable media tray assembly of claim 11 wherein:

the magnet comprises a first and a second magnet positioned on the housing adjacent to a left and a right side of the opening;

the latch plate further comprises a first and a second latch plate mounted on the inner surface of the front wall opposite the first and the second magnet, respectively;

the release surface further comprises a first and a second release surface each positioned adjacent to one of a top and a bottom of the opening and the left and right side of the opening, respectively;

the upper mount further comprises a left upper mount and a right upper mount positioned on the outer surface of the front wall in an aligned, spaced apart relationship the lower mount further comprises a left lower mount and a right lower mount positioned on the outer surface of the front wall in an aligned, spaced apart relationship; and, the first member further comprises a left first member having a left pivot member depending therefrom and a right first member having a right pivot member depending therefrom, the left and right first members pivotally mounted to the left and right upper mounts, respectively;

a cross member interconnects the left and right first members, the cross member and left and right first members defining a space into which the finger bar is inserted;

the link further comprises a left link and right link depending from the finger bar, the left and right links pivotally mounted to the left and right lower mounts, respectively, with the second ends of the first and second links positioned adjacent to the first and second release surfaces, wherein, with the removable media tray received into the housing and the first and second magnets in abutment with the first and second latch plates, respectively, providing a first and a second latching force FL1, FL2, respectively, and with a user-supplied actuation force FA applied to the finger bar to pivot the second member toward its second position, the left and right links pivot about the left and right lower mounts, respectively, contacting the left and right pivot members, respectively, pivoting the left and right first members with the respective second ends thereof applying a first and a second release force FR1, FR2, to the first and second release surfaces, respectively, to open the removable media tray and move the removable media tray away from the first and second magnets where FR1+FR2>FL1+FL2.

17. The removable tray assembly of claim 16 wherein FL is substantially equal to FL2 and FR1 is substantially equal to FR2.

18. The removable tray assembly of claim 16 wherein FL1 is not equal to FL2 and FR1 is greater than FL1 and FR2 is greater than FL2.

19. The removable tray assembly of claim 16 wherein the left and right pivot members form a continuous member connected to the left and right first members.

* * * * *